US005928059A

United States Patent [19]

Wicks

[11] Patent Number: 5,928,059

[45] Date of Patent: Jul. 27, 1999

[54] MATERNITY GARMENT

[76] Inventor: Trenna Ruston Wicks, 5775 22nd Ave., Naples, Fla. 34116

[21] Appl. No.: 09/014,254

[22] Filed: Jan. 27, 1998

[51] Int. Cl.[6] ..... A41C 1/08

[52] U.S. Cl. ..... 450/155; 2/408; 2/44

[58] Field of Search ..... 2/44, 45, 326, 2/408, 312, 400, 311, 406, 310, 73, 300; 450/155, 86

[56] References Cited

U.S. PATENT DOCUMENTS

| | | | |
|---|---|---|---|
| 3,114,951 | 12/1963 | DeMestral | 2/912 |
| 3,136,026 | 6/1964 | De Mestral | 2/912 |
| 4,789,372 | 12/1988 | Wicks | 450/155 |
| 4,835,795 | 6/1989 | Lonon | 2/408 |

*Primary Examiner*—Gloria Hale

[57] ABSTRACT

The present invention relates to a garment which provides abdominal support, especially for pregnant women. The garment includes a panty and support straps. there are two support straps fastened to the front of the panty and from there they pass each over the shoulder of a wearer, they crisscross in the back, they each pass over the hip of a wearer and then the supporting straps are overlappingly and adjustably fastened to each other below the abdomen. This arrangement transfers the weight of the abdomen to the shoulders of the wearer and prevents the person from assuming a slouching posture. The supporting straps are knitted from elastic yarns and the knitted loops face forward, that is, away from the person. These knitted loops form one part of hook and loop fasteners. Other lateral straps each are fastened to the front of the supporting straps, they each pass through loops at a side waistline of the panty and then are fastened on the back of the supporting straps. These lateral straps direct the support straps outwardly from the neck. The panty has a crotch that can be opened and closed.

6 Claims, 3 Drawing Sheets

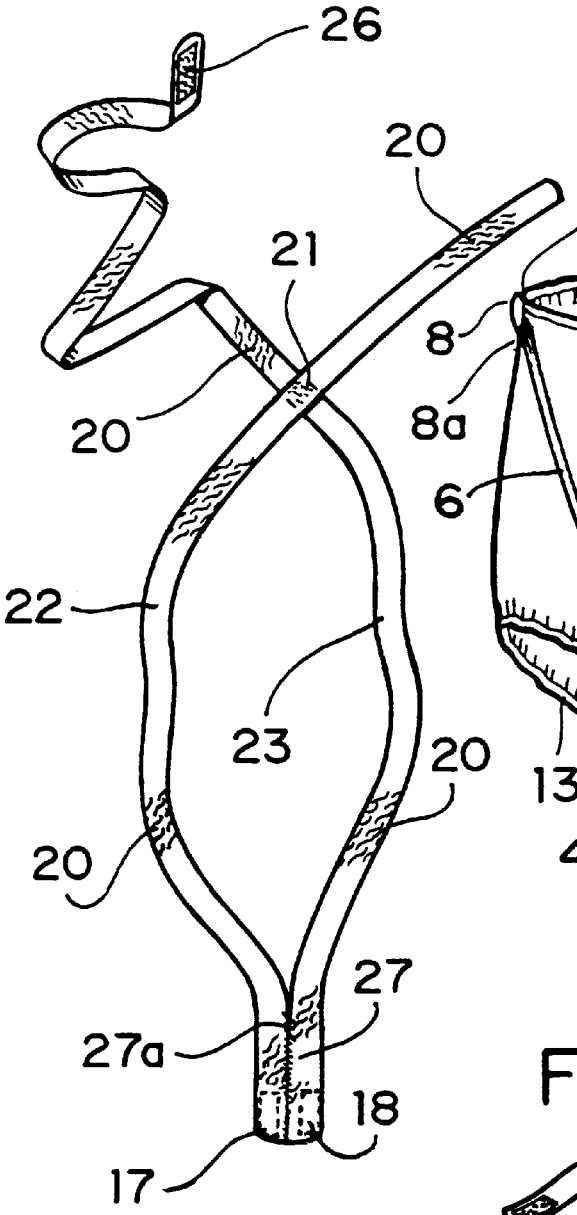
FIG. 2
FIG. 1
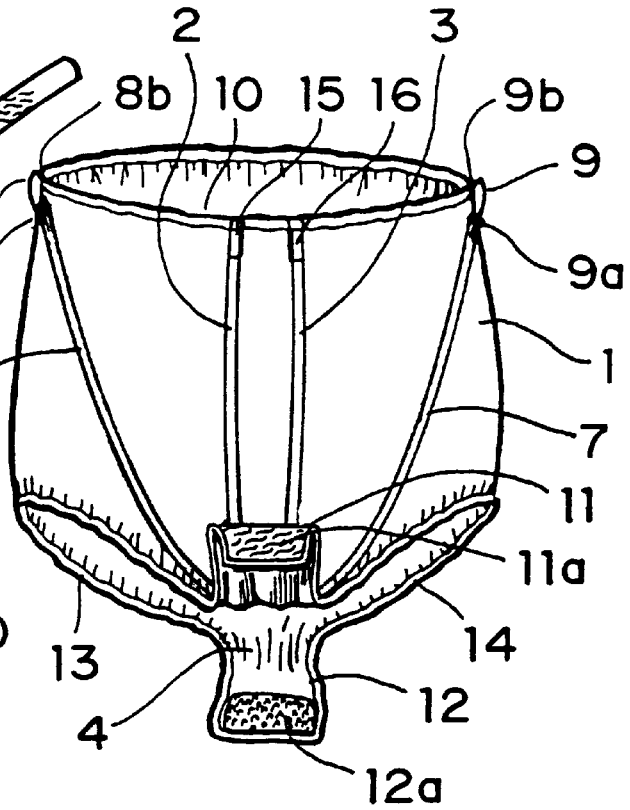
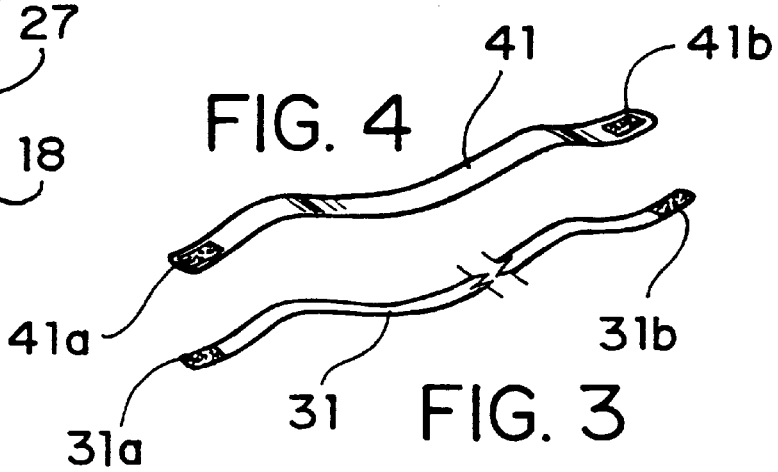
FIG. 4
FIG. 3

20
20
22
23
31b
31
31
22
31
21
23
10
8
1
8a
27
3
6
2
22
23
41a
41
14
26
12
13

MATERNITY GARMENT

FIELD OF THE INVENTION

This invention relates in general to garments which lend support to the abdomen of a wearer. More specifically, the present invention discloses a garment which supports the abdomen of a pregnant women and includes a panty and support straps which lift the abdomen and transfer weight from the abdomen to the shoulders by way of the back of the wearer.

BACKGROUND ART

It has long been known that increased weight in the abdominal area, such as occurs during pregnancy, increases the strain on the lower back, causing pain and stress on the musculature of the back. Commonly as pregnancy develops, so, too does lordosis which is, an abnormally exaggerated, forward curvature of the lumbar spine. The resulting posture and/or pain and its effects on life and work are expensive due to the need for rest, reduced activity, and even hospitalization, with accompanying loss of income and psychosocial dysfunction. In the past, efforts have been made to transfer the weight of the abdomen to other parts of the body, particularly the shoulders. Garments have been devised with straps leading from a pouch worn over the abdomen directly to the shoulders, in the front of the body of a wearer, thus hypothetically lifting the weight of the abdomen. In practice, such devices often pull the shoulders down rather than lifting the abdomen. Other devices attempt to transfer the weight of the abdomen to the back region of a wearer but can actually result in increased lordosis and pain if the weight is not transferred in a proper manner. There exists a need in the art for a garment which supports the abdomen and transfers the weight of the abdomen efficiently to the shoulders and back of a wearer by way of the back of the wearer without increasing and, while in fact, resulting in a decrease of lordosis. The garment should lift the weight of the abdomen rather than merely pulling down the shoulders of the wearer. At the same time the garment will be lifting weight of the ligaments and muscles of the pelvis alleviating discomfort from or even preventing varicose veins, organ sagging or pelvic muscle weakness.

OBJECTS OF THE INVENTION

It is an object of the invention to provide a garment which provides abdominal support to the wearer by transferring the weight of the abdomen by way of the back of the wearer and up to the shoulders of the wearer. It is a further object of the invention to achieve abdominal lift without pulling the shoulders of the wearer downward or causing the wearer to slouch. Another object of the invention is to provide a garment which decreases lordosis and alleviates pain in the lower back. Yet another object of the invention is to provide a garment which is comfortable to wear both in its fit and in its mechanical redistribution of the weight of the abdomen. A further object of the invention is to provide a garment which transfers abdominal weight to an outer portion of the wearer's shoulders and does not compress the portion of the wearer's shoulder near the wearer's neck.

SUMMARY OF THE INVENTION

The present invention achieves the foregoing objectives by constructing a garment that includes a panty and two support straps. Each support strap has a first end and a second end. The first end of the first support strap is affixed to a center front portion of the panty. The first support strap extends upwardly over one shoulder of the wearer, across the wearer's lower back and down over one of the wearer's hips and to beneath the abdomen. The second support strap also has a first end and a second end. The first end of the second support strap is affixed to the first end of the first strap and to the top center front portion of the panty. The second support strap extends upwardly over the other shoulder of the wearer across the wearer's lower back and down across the opposite hip of the wearer. The second support strap further wraps underneath the abdomen of the wearer. The present invention also includes a means for connecting near their second ends of the first and the second support straps to each other.

The present invention may also include first and second lateral straps, each having a first end and a second end. A first end of the first lateral strap is affixed to the first support strap and the second end of the first lateral strap is affixed to a side portion of the panty. The first end of the second lateral strap is affixed to the second support strap while the second end of the second lateral support strap is affixed to an opposite side portion of the panty. Both ends of the first and the second lateral straps are affixed to the two main supporting straps at about the shoulder blade level. The first and the second lateral straps pass through respective loops formed at the waist line and respective sides of the panty. The lateral straps act to direct the support straps outward and away from the neck of the wearer.

The garment of the present invention may further include a reinforcing strap having two ends and designed to wrap under the abdomen of the wearer. The reinforcing strap also includes means for affixing the ends of the reinforcing strap to the two support straps near the hips of the wearer. The panty of the present invention may further include at least one center reinforcing ribbon which extends from the center front portion of the panty to a crotch portion of the panty.

The panty may also include a pair of laterally positioned, lateral reinforcing ribbons. The first end of each lateral reinforcing ribbon extends from a side upper edge of the panty to the center reinforcing ribbon in an area near the crotch of the panty. The reinforcing ribbon lends structural support to the panty. The upper end of this ribbon at the side waist of the panty provides for the attachment of the lateral straps. The size of the panty of the present invention may be such that an upper edge of the panty extends above the naval of the wearer.

My prior U.S. Pat. No. 4, 789,372 issued on Dec. 6 1988 discloses all of the above recited objects and the above patent is hereby incorporated by reference. The prior patent and the present invention use the same structural layout but with different materials. The prior patent uses stretchable cotton support straps while the present invention uses knitted synthetic straps. In the prior patent all connecting or attaching points are constituted by hook and loop fasteners or by metal hooks and eyes that are attached to the main strap and the lateral straps to the panty. Care has been taken in the prior patent that all hook segments of the hook and loop fasteners, when attached to any structural elements, face toward the body of the wearer wherever feasible. The purpose for this is so that any other garments that are worn over the maternity garment cannot snag on the hooks of the fastener. However it is inevitable that some hooks face forward from the body of a wearer so that other garments are being snagged. Such hook and pile fasteners are known as VELCRO TM.

Also, in the prior patent, all hook and pile segments have to be sewn to the stretchable support straps to obtain the necessary fastening or attachment points. This leaves very little room for adjustments unless the individual segments are rather long. In the present invention, the main supporting straps are made of a knitted synthetic material. The straps are stretchable and highly supportive. However, the biggest advantage in using this type of material is that there are ready-made loops available on one surface of the straps because of the knitted nature of the material. That means, that no further loop segments have to be sewn to the straps and the adjustability of the overall garments is improved because the other straps which carry the hook segments can be attached to the support straps at their most desirable, comfortable and efficient position. To reiterate, there are no hooks or male parts of the so-called hook and loop fastener facing outwardly away from the body of a wearer so that no outer garments can be snagged. This also enhances the most effective position of the garment on the body of the wearer. Other advantages will become apparent as the description continues.

BRIEF DESCRIPTION OF THE DRAWINGS

FIG. 1 is an illustration of the panty of the preferred embodiment of the invention.

FIG. 2 is an illustration of the two main straps of the invention.

FIG. 3 is an illustration of the two lateral straps of the invention.

FIG. 4 is an illustration of an additional support strap of the invention.

Figure 5:
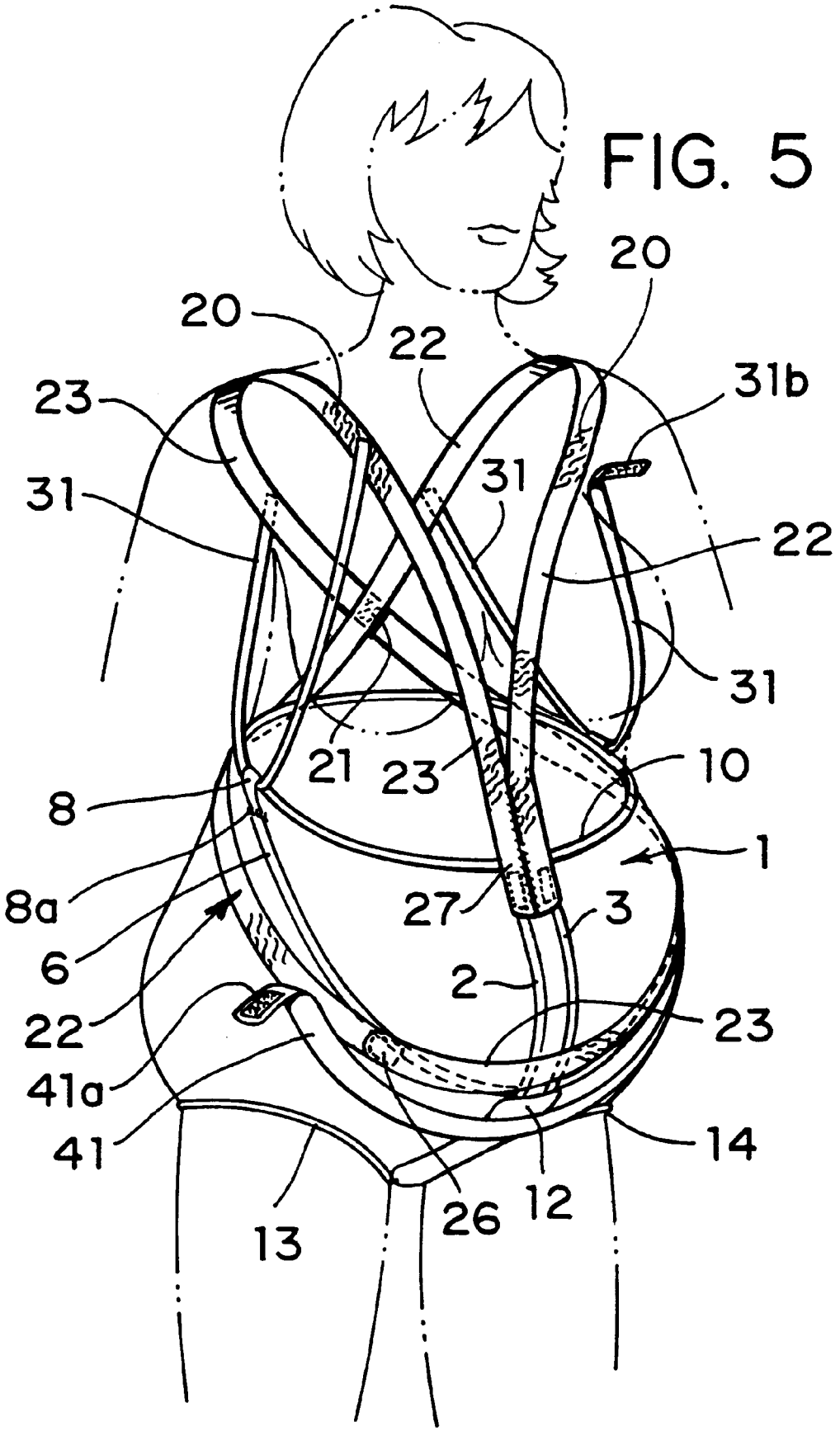
FIG. 5 is an illustration of the overall maternity garment superimposed on a phantom body.

DETAILED DESCRIPTION OF THE DRAWINGS.

FIGS. 1–4 illustrate the basic elements of the invention. For example, FIG. 1 illustrates a panty 1, preferably constructed from an elastic fabric, such as cotton spandex LYCRA TM. Two center reinforcing ribbons 2 and 3 are attached to the center front of the panty 1 and extend from the upper edge or waistline 10 of the panty to the crotch section of the panty. Alternatively, only one wide reinforcing ribbon 5 (FIG. 6) may be used as will be described later. The reinforcing ribbons are constructed from nonelastic material along their longitudinal axis. The reinforcing ribbons lend structural support to the center front portion of the panty. Additionally, the panty 1 includes two lateral ribbons 6 and 7 which extend from the side upper edges or waistline 10 of the panty 1 in toward the center reinforcing ribbons 2 and 3 in an area near the crotch 4 of the panty 1. These lateral reinforcing ribbons are similarly constructed of a non-stretch fabric and lend further structural support to the panty 1, particularly when used in conjunction with lateral straps 31. The lateral ribbons 6 and 7 are sewn to the panty 1 except for a short distance just prior to reaching the waistline 10. At these points the ribbons receive a bartack each at 8*a* and 9*a*, leaving a loop 8 and 9, respectively, with the ends of the loops 8 and 9 being fastened to the waistline 10. The purpose of the loops will be described later with reference to FIGS. 5 and 6. With further reference to FIG. 1, there is shown an openable crotch 4 consisting of an upper flap 11 and a lower flap 12. The upper flap 11 has a female loop material section 11*a* attached thereto while the lower section 12 has a male hook section 12*a* attached thereto. When the two sections 11*a* and 12*a* are combined with each other they will act in the well known VELCRO TM fastener system. The placement of the hooks and the loops is important within the spirit of the invention in that no male hook sections should be facing away from the body of the wearer to be able to snag any of the outer garments. The panty of FIG. 1 further shows leg bands 13 and 14. At the upper ends of ribbons 2 and 3 female loop sections 15 and 16 are provided which will receive male hook sections 17 and 18 shown in FIG. 2.

Turning now to FIG. 2 which illustrates the two support straps 22 and 23. The numeral 20 illustrates the symbol for the female loop fasteners of VELCRO TM. The two support straps are made of knitted elastic threads and by virtue of knitting, the straps are rendered elastic and at the same time there are loops on one side of the straps. These loops on one side of the straps are taking advantage of when the garment is assembled or worn. One of the straps 22 is shorter than strap 23 for reasons to be explained later. The straps cross in the back of the wearer and are adjustably fastened to each other by using a male hook fastener 21 attached to the underside of support strap 23. In the front of a wearer the straps are joined to each other to result in a double width as at 27. The joining is obtained by stitching resulting in a connection at 27*a*. This connection allows for ease of putting on or taking off the garment. Male hook sections 17 and 18 are fastened to the underside of the double width 27. The longer strap 23 has at its outer end a male hook section 26 which will be explained below.

FIG. 3 shows one of the two lateral straps 31 having male hook fasteners at both of its ends. The lateral straps 31 are constructed of fabric which is elastic along its longitudinal axis. The lateral straps 31 also have male hook fasteners attached at their ends for reasons to be explained later.

FIG. 4 illustrates the reinforcing strap 41 which is preferably constructed of a material which is elastic along its longitudinal axis. The reinforcing strap 41 has male hook sections 41*a* and 41*b* at each of its ends.

Figure 6:
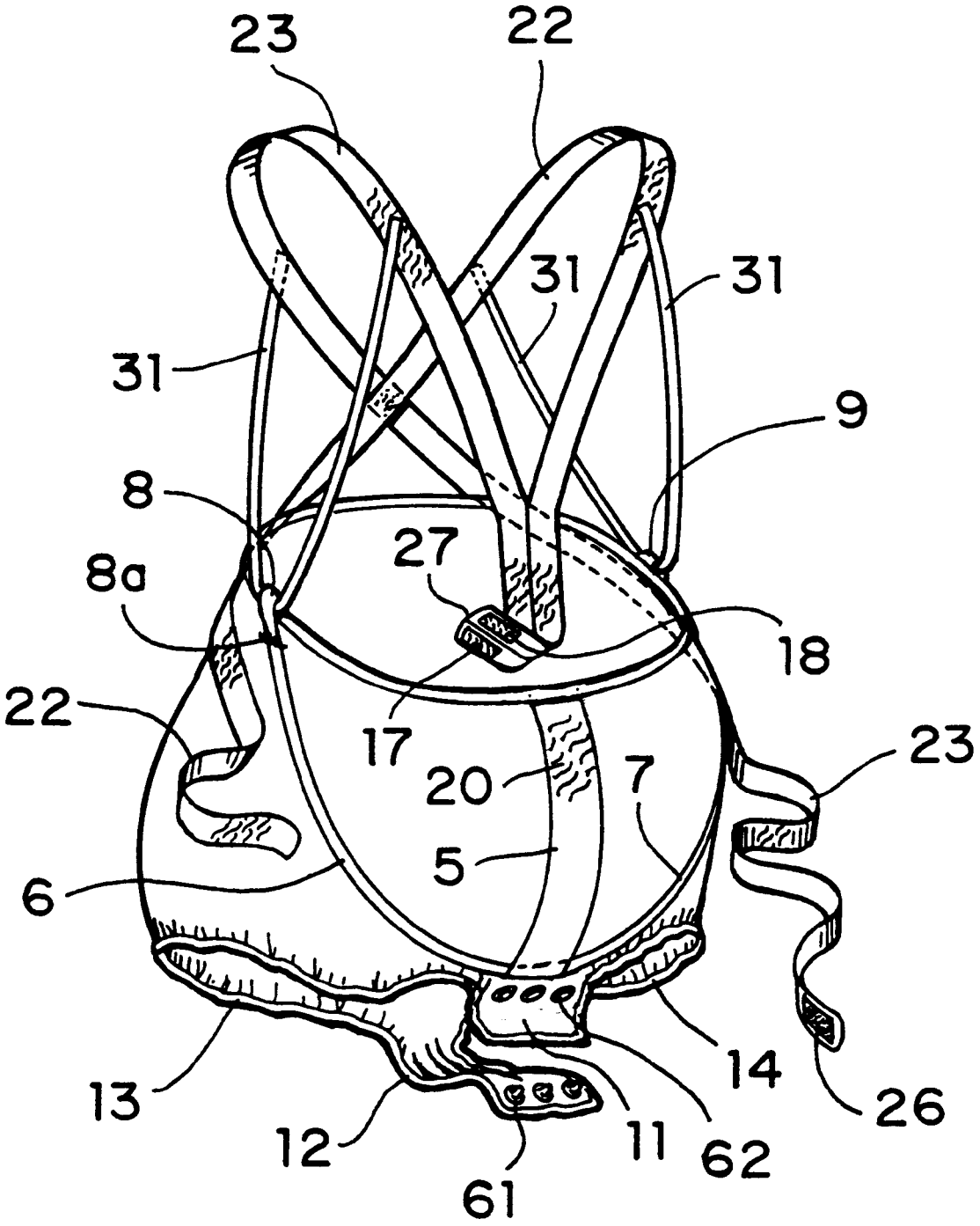
FIG. 6 is a perspective view of the maternity garment in three dimensions.

The use of the garment will now be explained by having reference to FIGS. 5 and 6. When the garment is donned, the panty 1 will be put on first. The panty is worn as a normal panty. Preferably, the upper edge or waistline 10 is situated well above the navel of a wearer for greater comfort and support. Thereafter, the first 22 and the second 23 support straps are placed over the shoulders of the wearer and the double strap 27 will be fastened to the two front female loop sections 15 and 16 by way of its own two male hook sections 17 and 18. The two support straps 22 and 23 cross in the back of a wearer because of their connection at 21 and the longer strap 23 is passed to the front and under the abdomen of a wearer. The shorter strap 22 passes around the other side of the wearer until it meets the longer strap 23. A length adjustment is made to take the comfort of the wearer into account by fastening the male hook section 26 of the longer strap 23 to a location on the shorter strap 22. Because the outside surface of the support straps being all-female loops, a multitude of adjustment points is available. Next, the crotch area 14 should be closed by pulling down the upper crotch flap 11 and thereafter overlapping the lower crotch flap 12 over the upper crotch flap 11. The male and female hook 12*a* and female loop 11*a* fastener will now engage each other and securely hold the two flaps together. The same is true when the snap fasteners 61 and 62 (FIG. 6) are used instead of using the hook and loop fasteners. The lateral straps 31 are now passed through their respective loops 8 and 9 at the lateral waistline of the panty 10 and then upwardly in front of and in back of the axillae, or armpits, of the wearer. The male hook sections 31*a* and 31*b* are now attached to the support straps 22 and 23 where appropriate and the male hook sections 31*a* and 31*b* will securely engage the female hoops on the support straps. These lateral straps 44 direct the support straps 22 and 23 outward from the neck of the wearer and thus prevent the support straps 22 and 23 from resting on the wearer's neck muscles, where there are sensitive nerves and blood vessels. The lateral straps 31 also provide extra lift to the abdomen.

If so desired or if necessary, the reinforcing strap 41 may now be attached by way of the male hook sections 41*a* and 41*b* to the female loop surface of the two support straps 22 and 23 at an area just above the hips. The reinforcing strap is used where extra lift and support are needed. The reinforcing strap 41 may prove particularly beneficial to women who have hyperlordosis or who are carrying twins or who experience severe lower back pain and discomfort.

SUMMARY OF THE INVENTION

In view of all of the above, the garment of the present invention provides lift and support to the abdominal area of a wearer. In particular, the support straps lift the abdomen and transfer the weight along the longitudinal axis of the support straps over the hips and toward the direction of the lower back region. The weight is then further transferred from the lower back region up along the back toward the shoulders. Thus, some of the weight of the abdomen is transferred to the hips and shoulders by way of the adjustable crisscross junction 21 at the lower back region. The present invention achieves lift of the abdomen but does not pull down the shoulders of the wearer, and does not cause the wearer's shoulders to slouch. Rather, the weight that is transferred is distributed in a biomechanically safe and comfortable manner to stronger regions of the body. By specifically redirecting the forces caused by an enlarged abdomen, the present invention reduces lordosis, thus improving posture, and eases lower back pain caused by muscle weakness, ligamentous overstretching, and spinal joint compression. The present invention may be particularly beneficial to women with weak back muscles or with pelvic or groin varicosities or with idiopathic pain at the symphysis pubis. The garment not only reduces back and pelvic pain, but can be helpful in prolonging sports and fitness activities later into normal, pain-free pregnancy.

Other variations of the present invention are contemplated. For example, the garment may be worn without the lateral straps or the reinforcing strap when additional lift is not needed.

The number of ribbons on the panty may be varied also by eliminating the lateral ribbons 6 an 7 or by doubling the same for obesity support for men or women. An advantage has been created by passing each one of the lateral straps 31 through loops 8 and 9, respectively, in that the lateral straps are free to slide and readjust themselves within the loops as the upper body of the wearer moves to different positions.

The fact that the supporting straps 22 and 23 are elastic in their longitudinal direction aids in the comfort when wearing the garment because they will somewhat stretch when the body of the wearer moves. However, the elasticity is not of such a character to defeat the intended weight lifting of the abdomen. The biggest advantage of the present supporting straps lies in the fact that the straps are knitted from elastic yarns and that care has been taken that the knitting loops are concentrated on one surface of the straps. When the straps are worn on the body of a wearer, all loops face forward or away from the body. This way, all other connections to be made with other straps which carry the male hook sections will face toward the body and any outer garments cannot snag on the hooks.

What I claim is:

1. A garment for supporting the abdomen of a wearer, comprising: a panty; a first support strap having a first end and a second end, said first end having means for attaching to a center front portion of said panty, said first support strap is adapted to extend over a shoulder of the wearer across the lower back of the wearer, and over a hip of the wearer;

a second support strap having a first end and a second end, said first end having means for attaching to a center front portion of said panty, said second support strap is adapted to extends over another shoulder of the wearer, across the lower back of a wearer, over another hip of the wearer, and under the abdomen of the wearer, said first and second support straps are adapted to crisscross each other at the back of the wearer and said second ends of said support straps are adapted to overlap each other at the wearer's abdomen;

means for adjustably connecting said first and said second support straps to each other near their second ends;

said first and said second support straps being knitted with elastic yarns exhibiting knitted loops on one surface only, said knitted loops facing outwardly or away from the body of a wearer when said straps are worn, and a first lateral strap having a first end and a second end, said first and said second end having means for attaching to said first support strap, an approximate midpoint of said first lateral strap is slidingly received in a loop at a side portion of said panty; a second lateral strap having a first and second end, said first and second ends having means for attaching to said second support strap, an approximate midpoint of said second lateral strap being received in a loop at another side portion of said panty.

2. The garment of claim 1, including a reinforcing strap being elastic along its length and having means on both of its ends or fastening said ends to said overlapping support straps.

3. The garment of claim 1 including a crotch for said panty and having means for opening and closing the same.

4. The garment of claim 1, wherein said support straps that are crossing each other in the back of a wearer have means for adjusting the same relative to each other.

5. The garment of claim 1 including two parallel reinforcing straps fastened to the front of said panty.

6. The garment of claim 1 including a wide reinforcing ribbon fastened to the front of said panty.

* * * * *